US007406736B2

(12) United States Patent
Flick

(10) Patent No.: US 7,406,736 B2
(45) Date of Patent: Aug. 5, 2008

(54) STAND ALONE INTEGRATED CUSHION

(75) Inventor: Roland E. Flick, Elma, NY (US)

(73) Assignee: Gaymar Industries, Inc., Orchard Park, NY (US)

( * ) Notice: Subject to any disclaimer, the term of this patent is extended or adjusted under 35 U.S.C. 154(b) by 145 days.

(21) Appl. No.: 11/595,165

(22) Filed: Nov. 10, 2006

(65) Prior Publication Data

US 2007/0056115 A1 Mar. 15, 2007

Related U.S. Application Data

(63) Continuation-in-part of application No. 10/608,649, filed on Jun. 27, 2003, now abandoned.

(51) Int. Cl.
*A47C 27/10* (2006.01)
*A61G 7/057* (2006.01)

(52) U.S. Cl. ..... 5/713; 5/710; 5/715; 5/727

(58) Field of Classification Search ..... 5/694, 5/710, 713, 715, 722, 727
See application file for complete search history.

(56) References Cited

U.S. PATENT DOCUMENTS 4,890,344 A * 1/1990 Walker ..... 5/713
5,249,319 A * 10/1993 Higgs ..... 5/714
5,586,347 A * 12/1996 Frischknecht ..... 5/713
5,606,756 A * 3/1997 Price ..... 5/713
5,652,484 A * 7/1997 Shafer et al. ..... 318/16
6,058,537 A * 5/2000 Larson ..... 5/710
6,079,065 A * 6/2000 Luff et al. ..... 5/618
6,543,073 B2 * 4/2003 Wu ..... 5/713
6,591,437 B1 * 7/2003 Phillips ..... 5/713
6,813,790 B2 * 11/2004 Flick et al. ..... 5/713

* cited by examiner

*Primary Examiner*—Michael Trettel
(74) *Attorney, Agent, or Firm*—Roach Brown McCarthy & Gruber, P.C.; Kevin D. McCarthy

(57) ABSTRACT

The present invention is directed to a stand alone integrated mattress. The system has a self-contained mattress unit, at least one inflatable bladder, at least one fluid source, at least one dispersion unit and at least one control unit. The self-contained mattress unit has at least a head section and a foot section, and is capable of converting from a horizontal position or an inclined position to a chair-like conformation. There is at least one inflatable bladder in each section of the self-contained mattress unit. There is also at least fluid source. In addition there is at least one dispersion unit in each section and each dispersion unit provides a fluid, obtained from the fluid source, to a conduit which directs the fluid into the inflatable bladder positioned in the section of the dispersion unit. The control system is positioned in one of the sections and interconnected to each dispersion unit to control the dispersion of the fluid to the inflatable bladders in each section.

17 Claims, 5 Drawing Sheets

STAND ALONE INTEGRATED CUSHION

CLAIM OF PRIORITY

This application is a continuation-in-part of U.S. patent application Ser. No. 10/608,649 that was filed on June 27, 2003, now abandoned.

FIELD OF THE INVENTION

The present invention is directed to a cushion unit capable of having a portion of the cushion raised and lowered in relation to at least other portions of the cushion.

BACKGROUND OF THE INVENTION

Gaymar Industries, Inc., the assignee of this application, is a manufacturer of cushion like devices. These cushions which have at least one bladder are designed to contain fluids. In many cases the fluid is aqueous solutions and/or air. These cushions are used as seat cushions, mattresses, overlays and any other cushion designed to have a patient positioned thereon. Most of the cushions made by Gaymar are designed for therapeutic purposes.

Inflatable therapeutic cushions for patients have been known for many years. Many therapeutic cushions are designed to reduce "interface pressures"; the pressure encountered between a cushion and a patient's skin positioned on the cushion. It is known that interface pressures can significantly affect the well-being of immobile patients in that higher interface pressures can reduce local blood circulation, tending to cause bed sores and other complications. With inflatable cushions, such interface pressures depend (in part) on the air pressure within the inflatable support cushions.

There are numerous types of inflatable cushion designs. These designs have combinations of bladders that can (1) vibrate, (2) rotate, (3) create wave motions, (4) provide percussion, (5) provide support, and (6) combinations thereof (hereinafter referred to as "Objectives") to a user of the cushion. These designs have been incorporated in numerous cushion designs by Gaymar Industries, Inc. as of the filing of this application.

In particular, those cushion designs have been used in numerous Gaymar mattress systems. Those mattress systems 200, as illustrated in FIG. 1, have at least one inflatable bladder capable of performing an Objective 210, a control unit 220, and a conduit 230 that interconnects the control unit 220 to the inflatable bladder(s) 210. The control unit 220 can be outside the mattress system 200 (not shown) or within the mattress system 200, as illustrated in FIG. 1. For purposes of this application, we will only address those mattress systems that have the control unit within the mattress system.

We are making this limitation because the present invention is directed solely to self-contained mattress systems. Self-contained mattress systems are preferred in hospital settings because they are easier to clean—no disconnecting of hoses from the control unit and the bladder(s).

Self-contained mattress systems have the control unit 220 normally and preferably at the foot of the system 240, a plurality of bladders 210 designed to accomplish at least one Objective, and a plurality of conduits 230 that interconnect the bladders 210 to the control unit 230. In all prior Gaymar mattress systems and those known to Gaymar, there is a single control unit 220.

That single control unit 220, as illustrated in FIG. 2, has a plurality of input keys 221 interconnected to at least a microprocessor 222. That microprocessor 222 is at least interconnected to pumps, fans, valves and/or switches 223 that push, pull and/or allow (by potential energy contained in the bladder(s)) a fluid through the conduits 230 and the bladder(s) 210. The fluid is contained within a reservoir and/or ambient environment 224. In any case, the fluid is used in the respective bladder to obtain the desired Objective.

There are numerous problems with such self-contained mattress systems 200. One of these problems is that such mattress systems can remain horizontal 201 and/or incline from the horizontal position 201 to about a 45° incline 202 relative to the horizontal position 201 and from a bend point 203. The mattress systems with the above-identified technology is unable to effectively and reliably continue to obtain the Objectives and simultaneously convert the mattress system from a horizontal position to a chair-like position (having an angle greater than 75° (line 75) and less than 180° (line 180) relative to the horizontal position and taken from the bend point 203, and hereinafter referred to as the "Conversion").

Conventional mattress systems are unable to reliably make the Conversion because the one control unit, normally positioned at and/or near one of the ends 235, 240, has a plurality of conduits extending the length (L) of the mattress system 200. When the mattress system is converted from the horizontal position 201 and/or the inclined position 201 to a chair like conformation (greater than 75°) the conduits 230 kink, become deformed, and do not properly transfer the desired amount of fluid to the bladder(s) 210. And if the bladder(s) 210 fail to receive the desired amount of fluid, the bladder(s) 210 do not complete its Objective.

The present invention solves this problem and others.

SUMMARY OF THE INVENTION

The present invention is directed to a stand alone integrated mattress. The system has a self-contained mattress unit, at least one inflatable bladder, at least one fluid source, at least one dispersion unit and at least one control unit. The self-contained mattress unit has at least a head section and a foot section, and is capable of converting from a horizontal position or an inclined position to a chair-like conformation. There is at least one inflatable bladder in each section of the self-contained mattress unit. There is also at least fluid source. In addition there is at least one dispersion unit in each section and each dispersion unit provides a fluid, obtained from the fluid source, to a conduit which directs the fluid into the inflatable bladder positioned in the section of the dispersion unit. The control system is positioned in one of the sections and interconnected to each dispersion unit to control the dispersion of the fluid to the inflatable bladders in each section.

DETAILED DESCRIPTION OF THE PRESENT INVENTION

Figure 1:
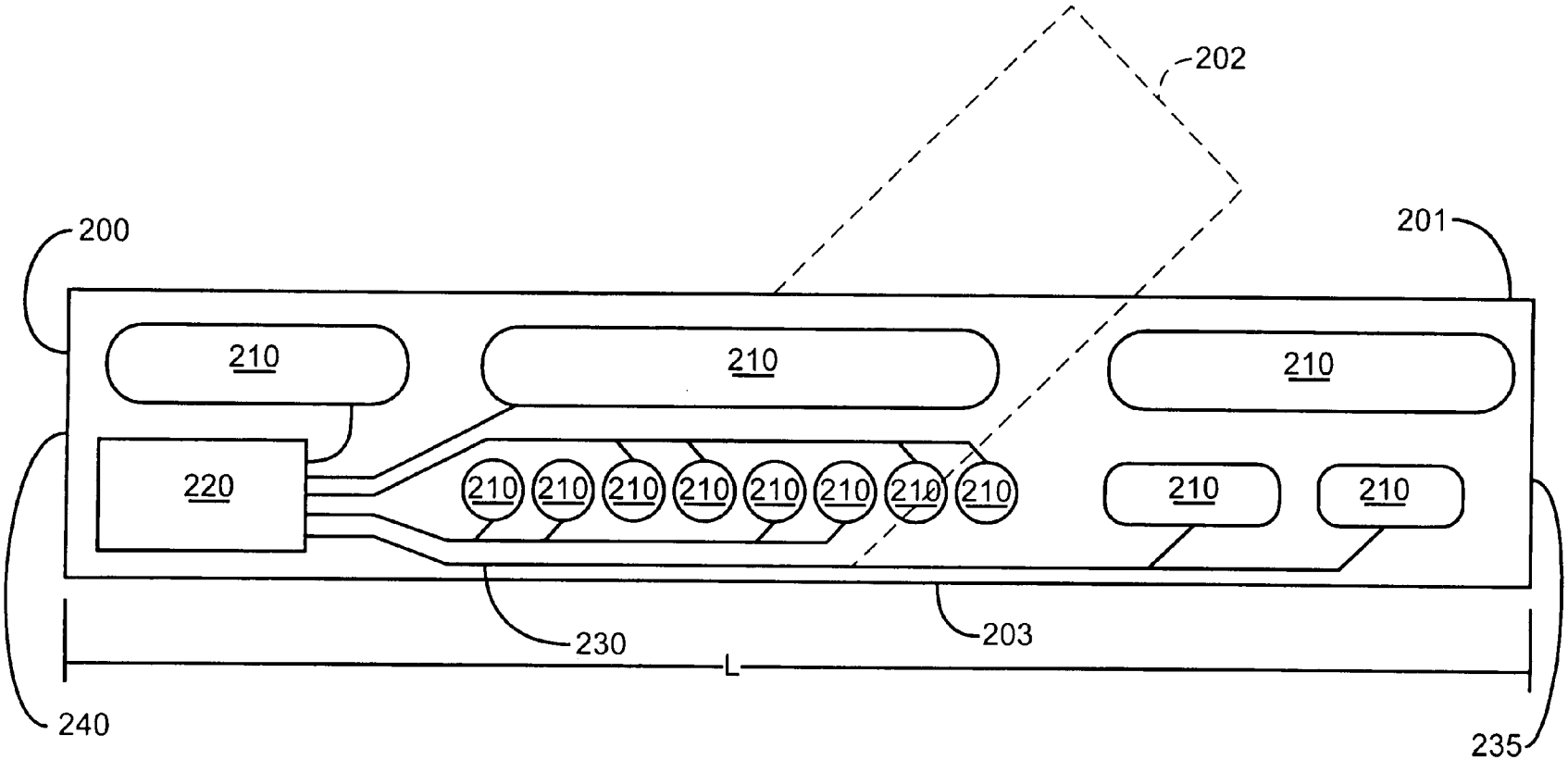
FIG. 1 (PRIOR ART)
FIG. 1 is a prior art illustration of a conventional inclinable and/or horizontal mattress system.

The present invention is directed to a mattress system 10 capable of being converted from the horizontal position 201 to a chair-like position 205, which has an angle of greater than 75° relative to the horizontal position 201 and the bend point 203. That in itself is not novel. There are plenty of such Conversion mattress systems and the mechanics of how the system moves from one position to another position is well known to those of skill in the art and therefore is not a part of the scope of this application. None of the conversion mattress systems, however, are self-contained systems that use inflatable bladders. The reasons are simple, self-contained mattress systems that use conduits kink, and disrupt the fluid dynamics in the conduits 230 to the inflatable bladders 210. That problem is solved by the present invention.

The present Conversion mattress system 10 has at least two inflatable bladders 210*a*, 210*b* and each is capable of performing an Objective, the same or different. The first inflatable bladder 210*a* is located at and/or between the distal end 235 and at least one of the bend point(s) 203; while the second inflatable bladder 210*b* is located at and/or between the proximal end 240 and at least one of the bend point(s) 203. The inflatable bladders 210*a*, 210*b* are capable of performing the Objective when each inflatable bladder receives a fluid. Each inflatable bladder 210*a*, 210*b* receives the fluid through a conduit 230*a,b* from at least one of two fluid dispersion units 227*a*, 227*b*. The fluid is obtained from a reservoir 224*a,b*. The reservoirs 224*a,b* can be the same or different and can provide the same or different fluids. The fluids can be an aqueous solution and/or a gas, like air.

The dispersion units 227*a* is positioned at or near the distal end 235, and the dispersion unit 227*b* is positioned at or near the proximal end 240. They are positioned near the ends 235, 240 because the normal human being who will be using the Stand alone integrated mattress system 10 applies and receives the least amount of pressure at these positions.

By having two dispersion units 227*a,b* the present invention (1) decreases the length of the conduit 230*a,b* to the respective bladder(s) 210*a,b* from the dispersion unit 227*a,b*, (2) generates less vibration, heat, and noise (less distance to push and/or pull the fluid), (3) decreases the chances of kinks and air occlusion in the conduits 230*a,b*, and (4) increases the reliability of the inflatable bladders 210*a,b* in the self-contained with inflatable bladder stand alone integrated mattress system 10.

The two dispersion units 227*a,b* are interconnected together through a control system 229. The control system 229 merely incorporates the input system 221 and the microprocessor unit 222 of the conventional control unit 220. Except in the present system 10, the control system 229 transmits its signals that control the units 223*a,b* through respective transmission lines 228*a,b*. Transmission lines 228*a,b* can become kinked and not adversely affect (1) the transmission of the signal from the microprocessor 222 to the dispersion units 227*a,b*, and (2) the operation of the system 10 when it converts from the horizontal position 201 to anything up to and including the chair-like position 205. Obviously, the control system 229 can be incorporated with the either dispersion unit 227*a* or dispersion unit 227*b*. Alternatively, each dispersion unit 227*a,b* could have control system 229, but that is undesired because it increases the cost of the unit and the technical ability to operate the system.

Figure 5A:
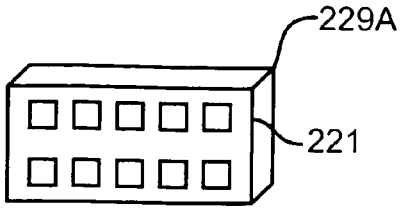
FIGS. 5*a-e* illustrate alternative embodiments of the present invention.
Figure 5B:
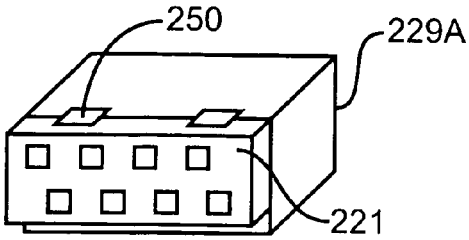
Figure 5C:
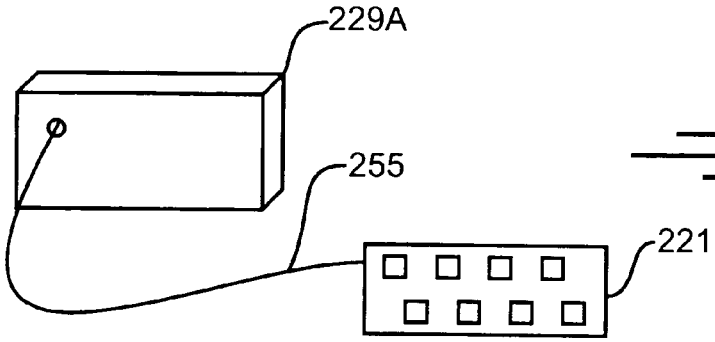
Figure 5D:
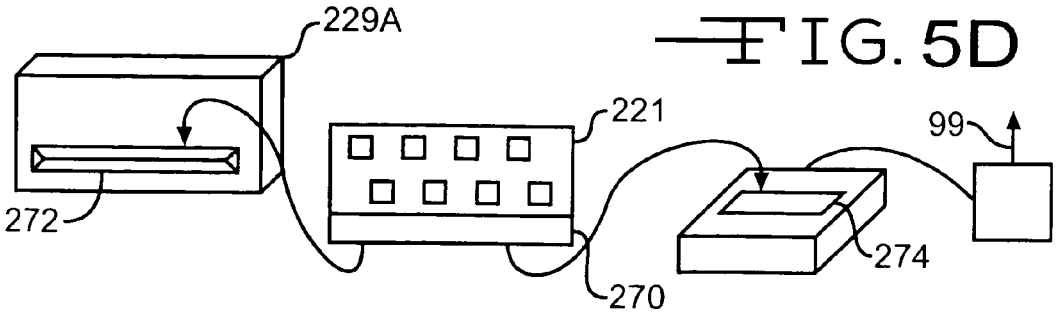
Figure 5E:
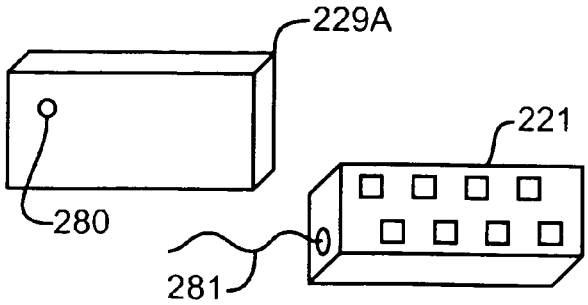

In addition, the input system 221 can have various designs. The input system 221 can be an integrated part of a control system box 229*a* which contains at least the microprocessor 222 and possibly the dispersion units 227*a,b*, as illustrated in FIG. 5*a*. This type of system is commonly used in conventional self-contained incline mattress systems, FIG. 1. The input system 221 can be electrically hinged 250 to the system box 229*a*, as illustrated in FIG. 5*b*. Alternatively, the input system 221 can be electrically tethered 255 to the system box 229*a*, as illustrated in FIG. 5*c*. In another embodiment, the input system 221 can be electronically slaved to the system box 229*a*. An example of being electrically slaved to the system box 229*a* includes and not limited to the input system 221 having a daughter SIMM board unit 270 extending from therefrom that is keyed only to fit into a particular SIMM socket 272 of control box 229*a*, and a master SIMM socket 274 to reprogram through a computer system 99, if necessary, the input of the input unit 221, as illustrated in FIG. 5*d*. It is understood that the mattress system 10, 200 will not operate if the input unit 221 is not installed in the particular SIMM socket 272. Another alternative embodiment, has the input unit 221 transmit a conventional remote signal 281, like rf or ir, to a respective receiver 280 on the control box 229*a*, as illustrated in FIG. 5*e*.

Figure 2:
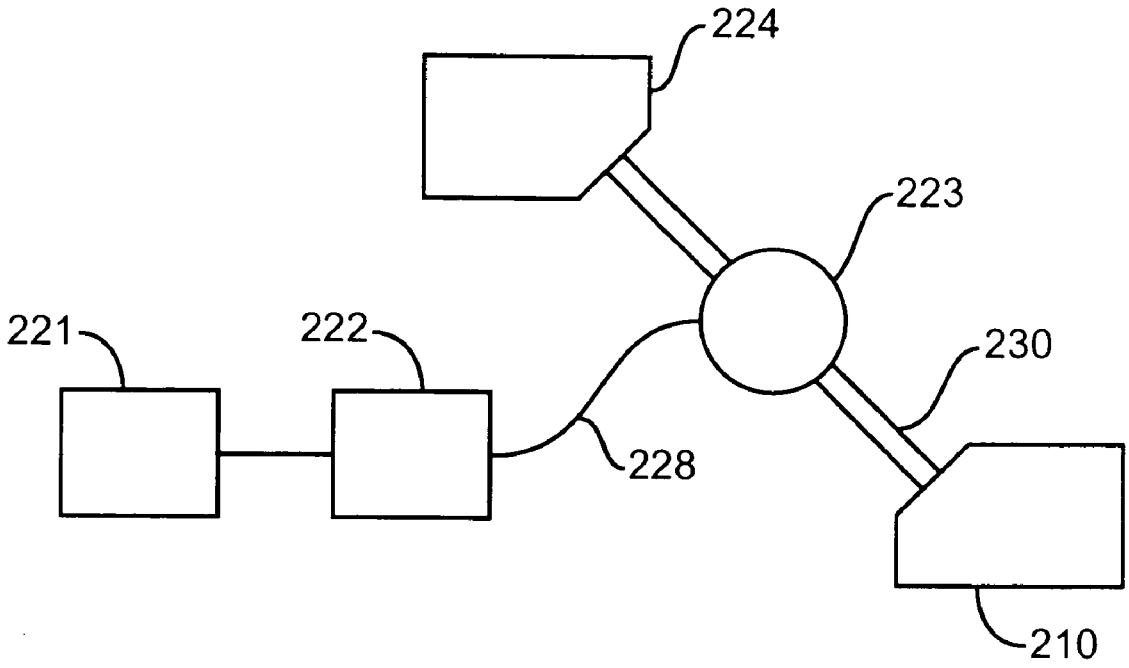
FIG. 2 (PRIOR ART)
FIG. 2 is a prior art schematic of how the mattress system of FIG. 1 operates.
Figure 3:
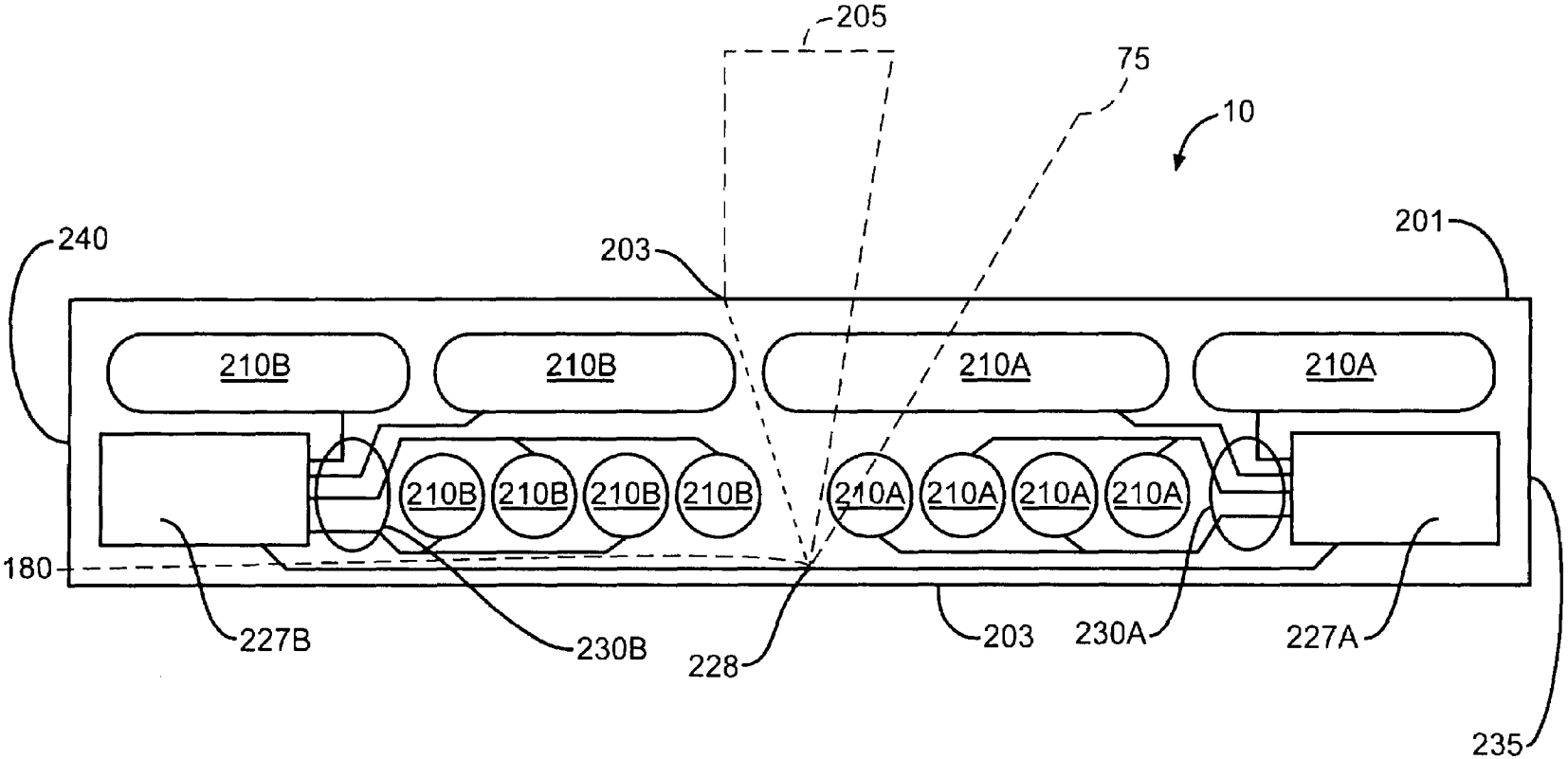
FIG. 3 illustrates the present invention.
Figure 4:
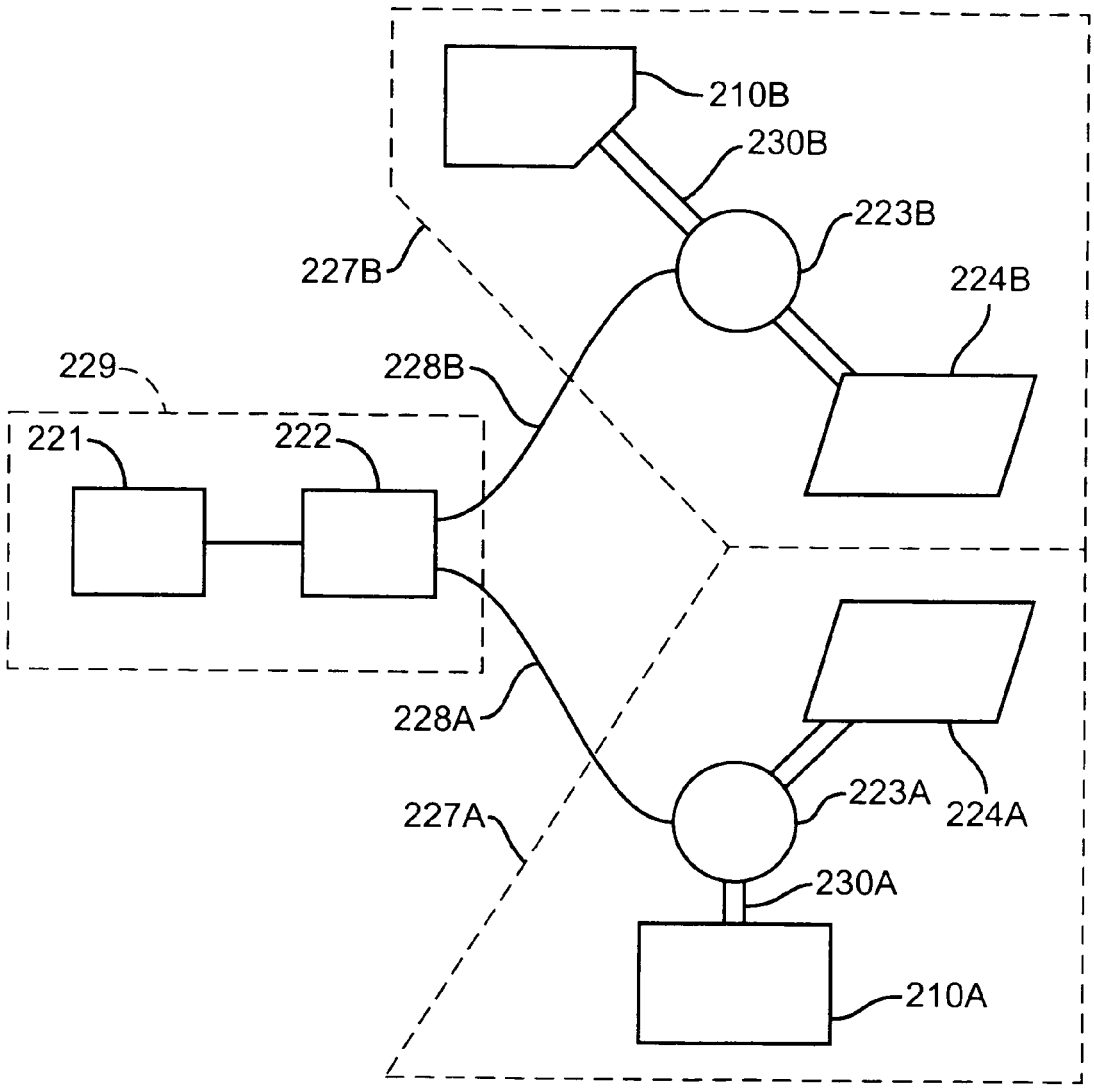
FIG. 4 illustrates the schematic of how the present invention operates.

To avoid any misinterpretation of terms, it should be noted:

A "dispersion unit" operates differently from a conduit. Control unit 220, as illustrated in FIG. 2, has a plurality of input keys 221 interconnected to at least a microprocessor 222. That microprocessor 222 is at least interconnected to pumps, fans, valves and/or switches 223. The pumps, fans, valves and/or switches are contained in the dispersion unit so the dispersion unit pushes, pulls and/or allows (by potential energy contained in the bladder(s)) a fluid to be directed into the conduits 230. The conduits merely guide the fluid into the bladder(s) 210, the power that pushes, pulls, and/or directs the fluid through a fluid manifold having valves into the bladder(s) 210 is provided through the dispersion unit, not the conduits. In addition, the control system 229 merely incorporates the input system 221 and the microprocessor unit 222 of the conventional control unit 220. Except in the present system 10, the control system 229 transmits its signals that control the units 223*a,b* through respective transmission lines 228*a,b* to the respective dispersion units. That way, the dispersion units receive the respective electrical signals to control the flow of fluid coming into and/or out of the dispersion units.

As a reminder, the first conduits and the first dispersion unit are only in either the head or foot section, not both sections, of the mattress while the second conduits and the second dispersion unit are in the opposite section of the mattress. The conduits in the present invention do not (a) pass the boundary between notches, in many cases, a notch is positioned between the head section and the foot section and (b) protrude outside the boundary of the conversion mattress system 10—otherwise the mattress is not a self-contained mattress as claimed. In other words the conduits are within the mattress system 10 and are not exposed so a patient or its visitor can see the conduits.

Conduits and dispersion units operate differently—conduits merely transport a fluid from one point to another point, while the claimed dispersion unit (a) operates in conjunction with electrical signals (instructions) and fans or pumps from the control system and (b) have fans or pumps that push or pull the fluid into and out of the dispersion unit.

The present invention uses electrical signals to communicate between the two different sections (foot and head) of the mattress. No cited reference disclose using such an electrical system in conjunction with the first dispersion unit and corresponding first conduits exclusively in the section of the mattress without the control system and the second dispersion unit and corresponding second conduits exclusively in the section of the mattress with the control system.

The present invention is not directed nor are the claims directed to a non-conversion, self-contained mattress. A non-conversion mattress has at least one mattress surface remain in a single plane, and has no notch in the mattress (as present in conversion mattresses) that allow the mattress to convert into a chair like conformation from a horizontal mattress, as claimed. Those notches are known to those in ordinary skill in the art to kink fluid hoses that protrude from one end of the bed to the other. The present invention avoids kinking by using an electrical signal through transmission lines and using fluid conduits only in particular sections of the mattress. Prior art embodiments (like Tappel in U.S. Pat. No. 5,542,136) have conduits that stretch the entire length of a non-conversion mattress. The length of those conduits if used in a conversion mattress (the present invention) would subject the conduits to kinking.

Tappel also discloses a single dispersion unit (manifold and valves) in the foot section of the mattress and no where else in the mattress. A single dispersion unit is only in one section of a self-contained mattress is applicable only for non-conversion mattresses and conversion mattresses that want kinks in conduits. Since kinks in hoses are undesirable, a single dispersion unit in a conversion, self-contained mattress is undesirable and contrary to the claimed invention.

The claimed invention calls for a conversion, self-contained mattress. Tappel does not disclose such a mattress. The use of a single dispersion unit (a manifold and valves) does not allow Tappel's mattress to be a self-contained conversion mattress because the fluid conduits that extend from the single dispersion unit will be kinked if it is ever converted to a conversion mattress. Moreover, contrary to the claimed invention Tappel has the conduits (or dispersion units as defined by the examiner) extend from one end of the mattress to the other end. That disclosure teaches away from the claimed invention.

In Tappel, item 113 is an "L-shaped tube." Tubes are conduits. Pursuant to the claim language, a dispersion unit is not and is never just a conduit and/or tube, it also contains a fan or pump that pushes or pulls the fluid into the dispersion unit and out of the dispersion unit through manifolds and/or valves. Accordingly, a mere tube, conduit or pipe is not a dispersion unit in the present invention.

Suzuki et al. (U.S. Pat. No. 6,108,843) disclose a conventional non-conversion (the bottom surface remains in a single plane) mattress that is unable to convert, or able to convert, from a horizontal mattress to a chair conformation as claimed. Instead, Suzuki et al.'s mattress is able to be altered from a horizontal mattress to just an inclined mattress wherein the bottom surface remains in a single plane—that is not a conversion mattress as claimed.

Suzuki et al. disclose "An air bed 10 . . . has five air chambers 10*a*, 10*b*, 10*c*, 10*d* and 10*e* each composed of an air-impermeable sheet . . . . On/off valves 11*a* to 11*e* are arranged on outer surfaces of the air chambers 10*a* to 10*e*, respectively. The on/off valves 11*a* to 11*e* are in gas communication with an air pump 13 through an air tube 12. The air pump 13 supplies compressed air to the air chambers 10*a* to 10*e* through the on/off valves 11*a* to 11*e*." The air tube 12 system essentially traverses the length of the mattress from the single fluid source. Suzuki et al. fail to disclose (a) a first set of air tubes extending from a first dispersion unit wherein the first set of air tubes and the first dispersion unit are positioned exclusively in the section of the mattress not having the control system, (b) the second set of air tubes extend from a second dispersion unit wherein the second set of air tubes and the second dispersion unit are positioned exclusively in the section of the mattress having the control system, (c) the control system transmits electrical signals to each dispersion unit to control the operation of each dispersion unit, (d) the mattress is a conversion mattress, and (e) a self-contained mattress system, as claimed.

While the preferred embodiment of the invention has been illustrated and described, it will be clear that the invention is not so limited. Numerous modifications, changes, variations, substitutions and equivalents will occur to those skilled in the art without departing from the spirit and scope of the present invention as defined by the appended claims.

I claim:

1. A stand alone integrated mattress comprising:

a self-contained mattress unit having at least a head section and a foot section, and capable of converting from a horizontal position or an inclined position to a chair-like conformation;

at least one fluid source;

a control system (a) positioned in either the head section of the self-contained mattress unit or the foot section of the self-contained mattress unit and (b) transmits an electrical signal through transmission lines to a first dispersion unit and a second dispersion unit, a first bladder in the section of the self-contained mattress unit without the control system and a second bladder in the section of the self-contained mattress unit with the control system;

the first dispersion unit is positioned in the section of the self-contained mattress unit without the control system, the first dispersion unit receives a signal from the control system that operates a fan or a pump in the first dispersion unit to pull or push fluid from the fluid source into the first dispersion unit, and the first dispersion unit directs the fluid into a first fluid conduit that transmits the fluid into the first inflatable bladder, the first fluid conduit is positioned exclusively in the section without the control system;

the second dispersion unit is positioned in the section with the control system; the second dispersion unit receives a signal from the control system that operates a fan or a pump in the second dispersion unit to pull or push fluid from the fluid source, and the second dispersion unit directs the fluid into a second fluid conduit that transmits the fluid into the second inflatable bladder, the second fluid conduit is positioned exclusively in the section with the control system;

the first inflatable bladder, the second inflatable bladder, the first dispersion unit, the first fluid conduit, the second dispersion unit, the second fluid conduit, the control system, and the transmission lines are within the self-contained mattress unit.

2. The stand alone integrated mattress of claim 1 wherein the at least one fluid source is ambient air.

3. The stand alone integrated mattress of claim 1 wherein the at least one fluid source is selected from the group consisting of a reservoir, ambient air and combinations thereof.

4. The stand alone integrated mattress of claim 1 wherein the fluid is selected from the group consisting of air and an aqueous solution.

5. The stand alone integrated mattress of claim 1 wherein the inflatable bladders are capable of vibrating, rotating, creating wave motions, providing not direct percussion, providing support, and combinations thereof to a user of the mattress.

6. The stand alone integrated mattress of claim 1 wherein the control system has an input unit that allows an operator to input data to control at least the inflation and/or deflation of the inflatable bladders.

7. The stand alone integrated mattress of claim 6 wherein the input unit is interconnected to the control system as an integrated component thereof.

8. The stand alone integrated mattress of claim 6 wherein the input unit is interconnected to the control system by a tethered electrical connection.

9. The stand alone integrated mattress of claim 6 wherein the input unit is interconnected to the control system through an electrically connected hinge.

10. The stand alone integrated mattress of claim 6 wherein the input unit has a SIMM daughter board that interconnects to the control system.

11. The stand alone integrated mattress of claim 6 wherein the input unit transmits a remote wireless signal to a receiver on the control system.

12. A stand alone integrated mattress comprising:

a self-contained mattress unit having at least a head section and a foot section and is capable of converting from a horizontal position or an inclined position to a chair-like conformation;

at least one fluid source;

a control system (a) positioned in either the head section of the self-contained mattress unit or the foot section of the self-contained mattress unit and (b) transmits an electrical signal through transmission lines to a first dispersion unit and a second dispersion unit, a first bladder in the section of the self-contained mattress unit without the control system and a second bladder in the section of the self-contained mattress unit with the control system;

the first dispersion unit is positioned in the section of the self-contained mattress unit without the control system, the first dispersion unit receives a signal from the control system that operates a fan or a pump in the first dispersion unit to pull or push fluid from the fluid source into the first dispersion unit, and the first dispersion unit directs the fluid into a first fluid conduit that transmits the fluid into the first inflatable bladder, the first fluid conduit is positioned exclusively in the section without the control system;

the second dispersion unit is positioned in the section with the control system; the second dispersion unit receives a signal from the control system that operates a fan or a pump in the second dispersion unit to pull or push fluid from the fluid source, and the second dispersion unit directs the fluid into a second fluid conduit that transmits the fluid into the second inflatable bladders, the second fluid conduit is positioned exclusively in the section with the control system;

the first inflatable bladder, the second inflatable bladder, the first dispersion unit, the first fluid conduit, the second dispersion unit, the second fluid conduit, the control unit, and the transmission lines are within the self-contained mattress unit;

the control system has an input unit that allows an operator to input data to control at least the inflation and/or deflation of the inflatable bladders the input unit is selected from the group consisting of the input unit (1) is interconnected to the control system by a tethered electrical connection, (2) transmits a remote signal to a receiver on the control system, (3) has a SIMM daughter board that interconnects to the control system, or (4) is interconnected to the control system through an electrically connected hinge.

13. The mattress of claim 12 wherein the control system is interconnected to each dispersion unit to control the dispersion of the fluid to the inflatable bladders in each section.

14. The mattress of claim 12 wherein at least one fluid source is ambient air.

15. The mattress of claim 12 wherein the at least one fluid source is selected from the group consisting of a reservoir, ambient air and combinations thereof.

16. The mattress of claim 12 wherein the fluid is selected from the group consisting of air and an aqueous solution.

17. The mattress of claim 12 wherein the inflatable bladders are capable of vibrating, rotating, creating wave motions, providing percussion, providing support, and combinations thereof to a user of the mattress.

* * * * *